US006802406B2

(12) United States Patent
Martin

(10) Patent No.: US 6,802,406 B2
(45) Date of Patent: Oct. 12, 2004

(54) RECOIL BRAKE ISOLATION SYSTEM

(75) Inventor: Joel Martin, Golden Valley, MN (US)

(73) Assignee: United Defense, L.P., Arlington, VA (US)

( * ) Notice: Subject to any disclaimer, the term of this patent is extended or adjusted under 35 U.S.C. 154(b) by 16 days.

(21) Appl. No.: 10/321,860

(22) Filed: Dec. 17, 2002

(65) Prior Publication Data

US 2004/0154465 A1 Aug. 12, 2004

(51) Int. Cl.[7] ..... F16F 9/42
(52) U.S. Cl. ..... 188/274; 42/1.06; 89/198
(58) Field of Search ..... 42/1.06; 89/43.01, 89/43.02, 42.01; 188/274

(56) References Cited

U.S. PATENT DOCUMENTS

| | | | | |
|---|---|---|---|---|
| 3,964,365 A | | 6/1976 | Zielinski | 89/43 |
| 3,991,650 A | * | 11/1976 | Garland et al. | 89/43.01 |
| 4,088,059 A | * | 5/1978 | Hayner | 89/43.02 |
| 4,587,882 A | | 5/1986 | Metz | 89/43.01 |
| 4,591,342 A | | 5/1986 | Lipp | 434/18 |
| 4,656,921 A | | 4/1987 | Zierler | 89/43.01 |
| 4,757,960 A | * | 7/1988 | Paris et al. | 244/3.22 |
| 4,867,038 A | | 9/1989 | Metz | 89/43.02 |
| 4,875,402 A | | 10/1989 | Metz | 89/43.01 |
| 4,955,281 A | | 9/1990 | Metz et al. | 89/43.01 |
| H001010 H | * | 1/1992 | Kasten et al. | 89/43.01 |
| 5,168,120 A | * | 12/1992 | Rossel | 89/43.01 |
| 5,555,919 A | * | 9/1996 | Lipp | 141/59 |
| 6,625,983 B2 | * | 9/2003 | Kawasaki | 60/468 |

FOREIGN PATENT DOCUMENTS

| | | |
|---|---|---|
| EP | 0491106 | 3/1995 |

* cited by examiner

*Primary Examiner*—Robert A. Siconolfi
*Assistant Examiner*—Devon Kramer
(74) *Attorney, Agent, or Firm*—Patterson, Thuente, Skaar & Christensen, P.A.

(57) ABSTRACT

A recoil brake isolation system for the hydraulic recoil brake cylinder of a large caliber gun, includes two sets of hydraulic valves disposed respectively within the inlet valve block and return valve block of the hydraulic cylinder, an orchestrated combination of which together block the flow of hydraulic fluid to or from the hydraulic cylinder during the recoil/counterrecoil cycle or upon failure of the hydraulic circuit. A method of hydraulically isolating a recoil brake cylinder of a large caliber gun for survivability and improved weapon performance and a gun incorporating such a system are also included.

31 Claims, 7 Drawing Sheets

RECOIL BRAKE ISOLATION SYSTEM

GOVERNMENT INTEREST

The invention described herein may be manufactured, used and licensed by or for the United States Government.

TECHNICAL FIELD

The present invention relates to artillery. More particularly, the present invention relates to a valve system for improving the survivability of a large caliber gun by isolating the hydraulic recoil system from the hydraulic power components during the recoil/counterrecoil cycle and preserving the hydraulic fluid in the recoil system upon failure of any, of the hydraulic supply or return components.

BACKGROUND OF THE INVENTION

The current trend in the military is for deployable lightweight units which provide comparable lethality and effectiveness as provided by multiple traditional heavier units. This trend particularly applies to artillery which benefits from advances in munitions and automatic loading schemes. For example, currently used 155 mm self-propelled howitzers have a maximum rate of fire of four rounds a minute for up to three minutes. In order to reduce the total deployed units, there is a need then for a single weapon with a rate of fire two to three times that of current units. The drawback to this approach is that a single component failure on the weapon could shut down the equivalent of an entire artillery battery.

There is a need then to ensure that the new artillery unit can withstand the increased operational demands. The weapon must be more reliable while maintaining high fire rates. In order to achieve the required firing rates, a number of subsystems within the weapon must evolve to withstand increased service demands. The sustained rate of fire creates extremely high temperatures within the barrel and the recoil system. Conventional large caliber guns utilize an integral sealed recoil brake in which a piston coupled to the barrel forces a fluid through a set of metering orifices during the recoil movement. As the firing rate increases so does the temperature of the fluid. Eventually the fluid reaches a thermal limit and the gun must stop firing.

There is a need then for a survivable cooled recoil system. A typical cooling system, utilizing a combination of pumps, filters and a heat exchanger, increases the complexity of the recoil system. The gun must be able to continue operating should one of these systems fail due to mechanical or operational reasons. Furthermore, a recoil brake for a large caliber gun generates hydraulic pressures as high as 6500 psi, vacuum conditions, pressure spikes, and reversals of flow all induced by the action of the recoil piston. A hydraulic fluid cooling system subject to such extreme operating conditions would be cost and size prohibitive.

There is a need then to provide a hydraulic recoil system for a large caliber gun that is capable of maintaining high rates of sustained fire. The recoil system should be cooled so as to maintain the high sustained fire volumes. The recoil system should be survivable so that the weapon does not become useless should a thermal control component fail or suffer damage. Further, the recoil system should not hinder deployability of the weapon by excessively increasing weight or size.

SUMMARY OF THE INVENTION

The recoil brake isolation system of the present invention substantially meets the aforementioned needs. The system uses two sets of valves to control fluid flow for use with any piston style hydraulic recoil brake requiring active cooling due to high rates of fire. One set of valves is disposed along the hydraulic fluid supply line for the recoil system while the other set of valves is disposed on the return line. Valve activation occurs due to changes in hydraulic pressure as experienced by individual valves. The system does not require any wiring, software or electrical controls. The present invention relates to the arrangement, orchestration and functioning of the valves during the various modes of recoil, counterrecoil, and subsystem failure.

During normal operations, the valves allow the fluid within the recoil brake to be circulated through the thermal dissipation system (TDS). Upon firing, the recoil/counterrecoil mode is automatically activated so that the valves protect the heat exchanger and fluid circulating equipment from pressure spikes, vacuum, high pressure conditions and reversal of flow. In the event of a subsystem failure, such as the loss of a supply line, the valves revert to a sealed mode system so as to minimize fluid loss and prevent ingestion of air by the recoil system. This allows continued operation of the weapon until thermal limits are reached. The system can return to operation after cooling below the thermal threshold.

The present invention is a recoil brake isolation system, adaptable to any large caliber artillery piece using a piston style hydraulic recoil system, which incorporates an arrangement of valves to control fluid flow within the recoil system so as to maintain high rates of sustained fire under normal firing situations and an isolation mode which allows for continued use if the thermal system is damaged or fails. The present invention is further a method of configuring a valve system so as to minimize weight and maximize survivability of a large caliber artillery piece.

DETAILED DESCRIPTION OF THE INVENTION

The recoil brake isolation system of the present invention is located within the recoil system 20 of a self-propelled howitzer. Any large caliber weapon, whether mounted on a vehicle platform such as a tank or self-propelled howitzer, or towed, in which sustained high rates of fire are planned, could utilize the present invention. Maintaining a high fire rate requires active cooling for the recoil system 20. In a first embodiment, the present invention is included on a self-propelled howitzer.

Figure 1:
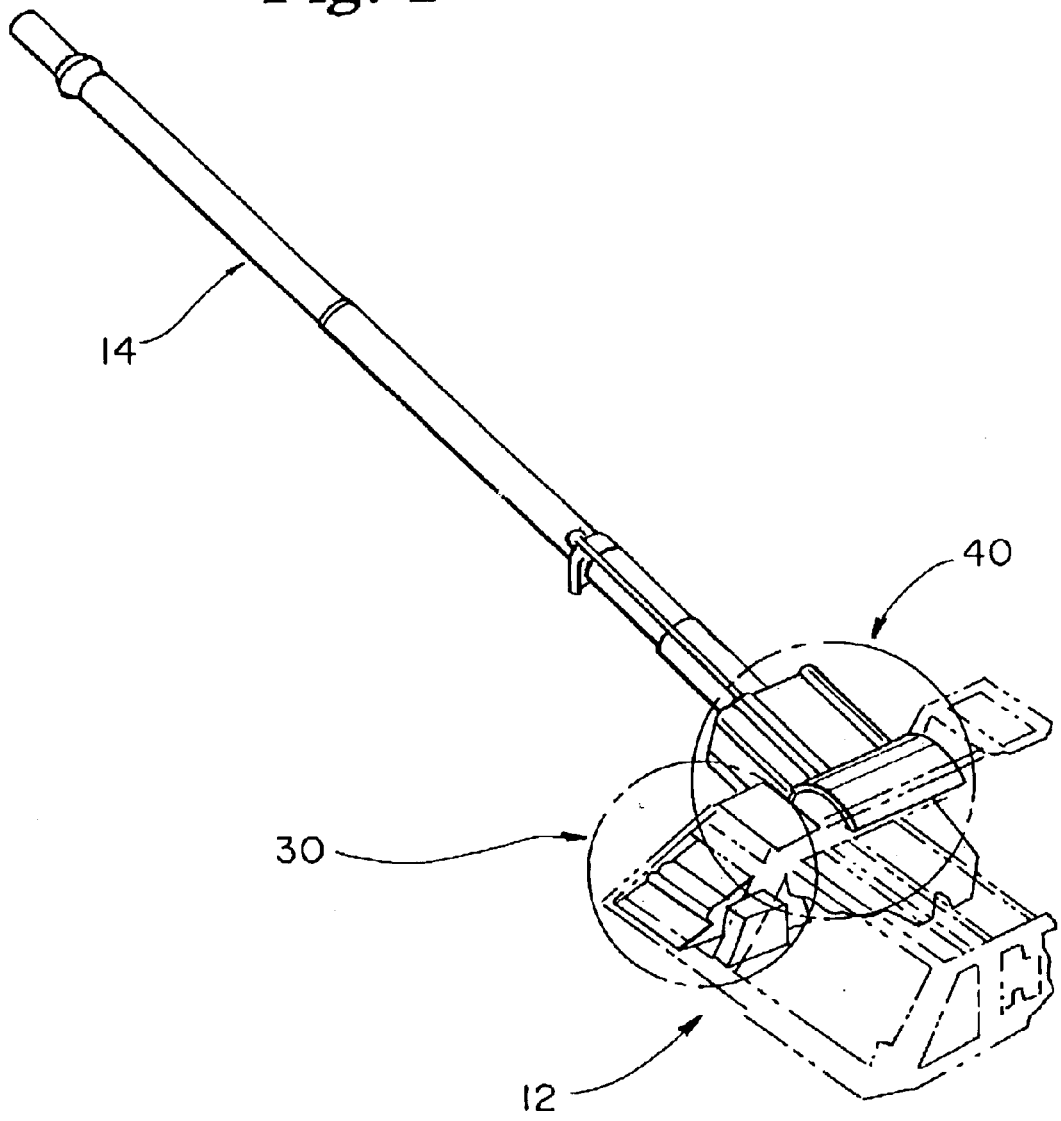
FIG. 1 is a perspective view of the gun with the turret area of a self-propelled howitzer in phantom with the gun mount system and thermal dissipation system highlighted.
Figure 4:
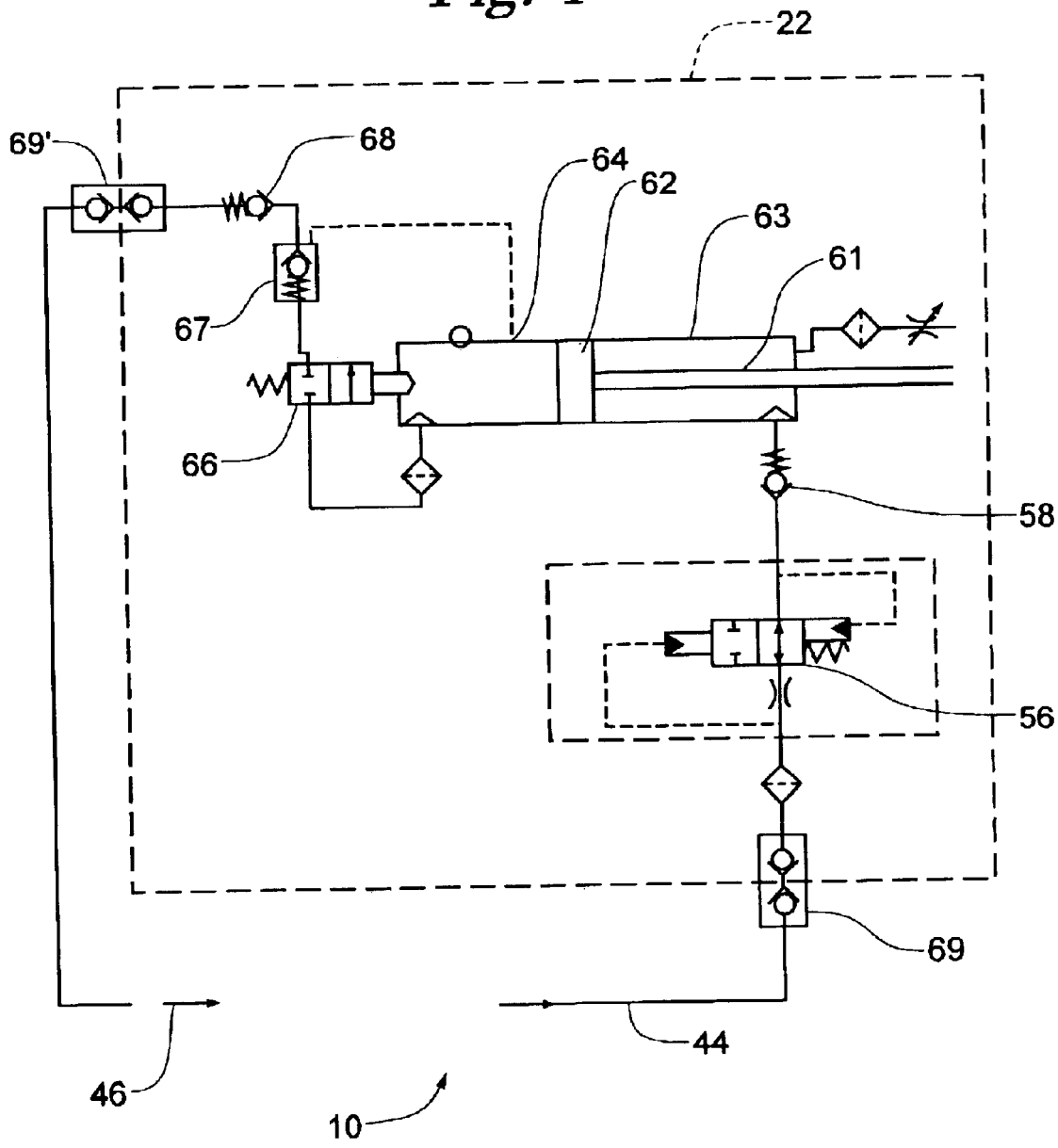
FIG. 4 is a schematic representation of the recoil brake isolation system including the recoil brake and hydraulic system.

Referring now to FIG. 1, the liquid cooled cannon 14 and recoil system 20 are contained within the gun mount 40 and are fluidly connected to the thermal dissipation system (TDS) 30. The TDS 30 operates to cool both the recoil system 20 and the cannon cooling system 15. In order to reduce the weight of the vehicle, and allow access for servicing and removal, the TDS 30 is not afforded the same level of armor protection as the adjacent recoil system 20 and cannon 14. Should the TDS 30 be damaged by enemy fire or fail due to a component malfunction, the recoil brake isolation system 10, as is illustrated in FIG. 4, allows for continued firing.

Figure 2:
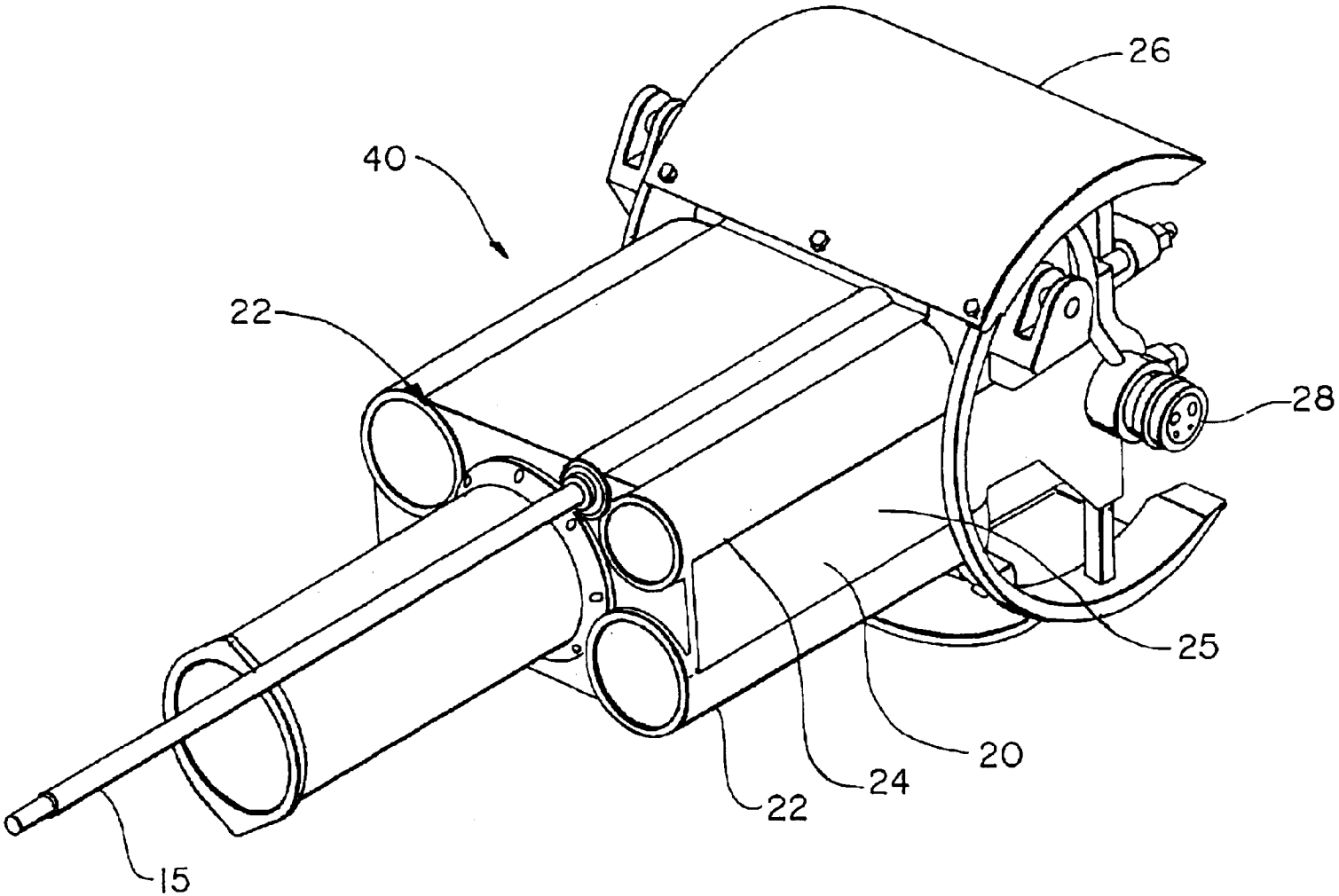
FIG. 2 is a front perspective view of the gun mount system for a self-propelled howitzer.

The gun mount 40, depicted in greater detail in FIG. 2, is comprised of the cannon cooling system 15, a pair of recoil modules 22, and a pair of recuperator modules 24, all installed within the gun cradle 25. The recuperator module 24 is used to control the position of the gun after recoil in preparation for the next firing. The gun mount 40 is rotationally elevatable about trunion 28. An armored shield assembly 26 is mounted above and below the cradle 25. Note that the recoil module 22 and recuperator module 24 are mounted as pairs in alternating order on each side of cannon 14 so as to counteract the dynamic torque created during recoil/counterrecoil.

Figure 6:
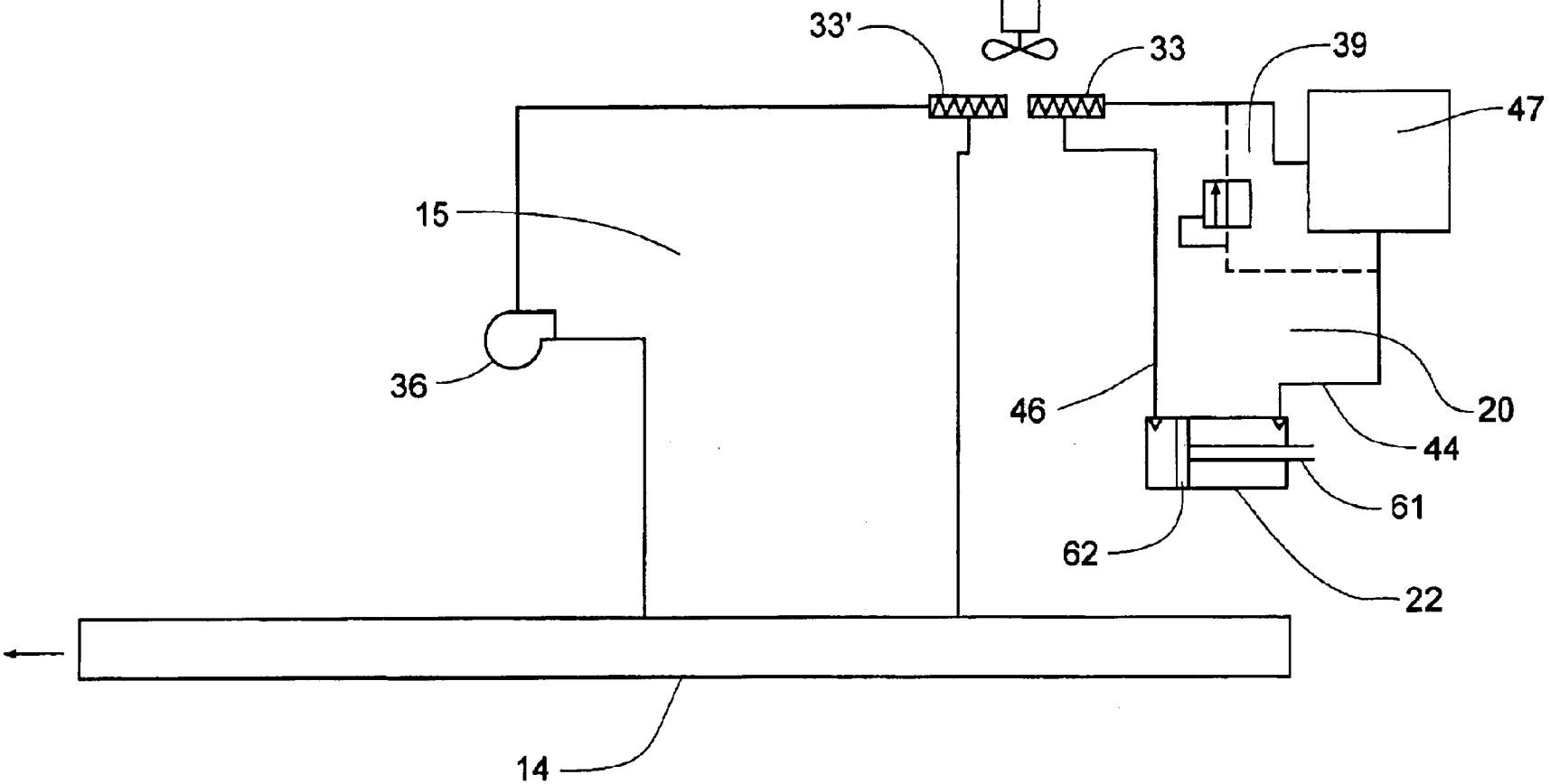
FIG. 6 is a block diagram representation of the gun cooling system and recoil cooling system for a self-propelled howitzer.

The TDS 30, as depicted in FIG. 6, contains two separate cooling circuits utilizing a common cooling fan 31 and heat exchanger 33. The recoil system 20 is cooled through the circulation of a silicone brake fluid manufactured pursuant to Military Specification MIL-B-46176 or MWL-PRF46176, although any comparable fluid would be acceptable. The cannon cooling system 15 dissipates heat through the circulation of an antifreeze solution, the composition of which is well known in the art.

Figure 3:
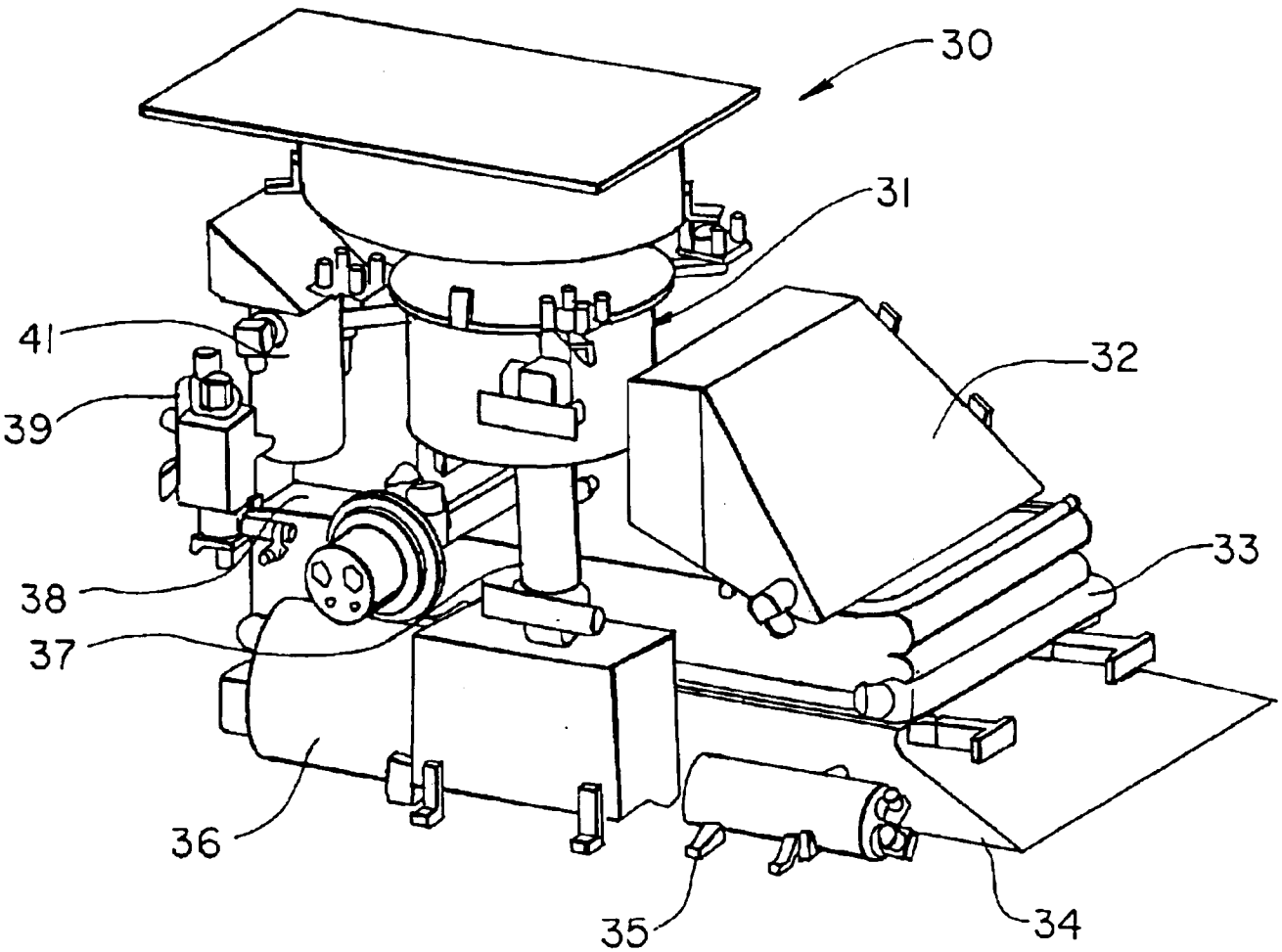
FIG. 3 is a side perspective view of the components of the thermal dissipation system for the recoil modules and cannon cooling system.

Referring to FIG. 3, hydraulic fluid leaving the recoil module 22 flows to heat exchanger 33 which is fluidly connected to the recoil reservoir 32. Air inlet 34 is disposed proximate to the base of the TDS 30 along the slanting outer sidewall of the howitzer 12, and provides the air required to cool the heat exchanger 33. The hot exhaust from the heat exchanger 33 is blown by cooling fan 31 through an exhaust vent 42 mounted on top of the howitzer 12. Pressurized hydraulic fluid from recoil coolant pump 35 is controllably directed to the recoil relief valve 39 which maintains a predetermined fluid compression. The pressurized fluid is then controllably directed through a filter 41 before reentering recoil module 22. Likewise, the TDS 30 cooling circuit for the gun 14 utilizes the same heat exchanger 33 and cooling fan 31 and comparable pump 36 and reservoir 38 but provides thermal dissipation by circulating the antifreeze solution.

The present invention isolates the entire TDS 30 during recoil and counterrecoil and, if any component of the TDS 30 fails, the present invention will maintain the isolated mode so as to conserve the hydraulic fluid within the recoil module 20. The recoil brake isolation system 10 also prevents ingestion of air, potentially a catastrophic failure, should a return or supply line fail. In the event of component failure or damage by an enemy, the recoil brake isolation system allows for continued firing, at a reduced rate of fire comparable to that of a howitzer without active cooling.

An added advantage produced by the recoil brake isolation system 10 is a reduction in the TDS 30 design requirements. The recoil brake isolation system 10 effectively blocks the flow of hydraulic fluid from the TDS 30 thereby eliminating the design requirements of operating with high pressures (on the order of 6500 psi), vacuum, pressure spikes and reversal of flow. In the preferred embodiment, the TDS 30 is sized to withstand pressures of 400 psi. The lower pressure requirements result in smaller components, less weight and less cost for the TDS 30. Note that the internal valve components of the recoil module 22 must be sized for the higher pressure requirements.

The recoil brake isolation system is comprised of the supply line isolation system 54 and the return line isolation system 59. Referring to FIG. 6, the hydraulic power unit 47 of TDS 30, which contains pump 35, reservoir 32, relief valve 39, and filter 41 is fluidly connected to recoil module 22 by way of hydraulic fluid supply line 44 and hydraulic fluid return line 46. Hydraulic fluid supply line 44 is fluidly connected to inlet supply valve block 50 in which the supply line isolation system 54 is disposed and hydraulic fluid return line 46 is fluidly connected to return valve block 52 in which the return line isolation system 59 is located. See FIG. 5.

Figure 5:
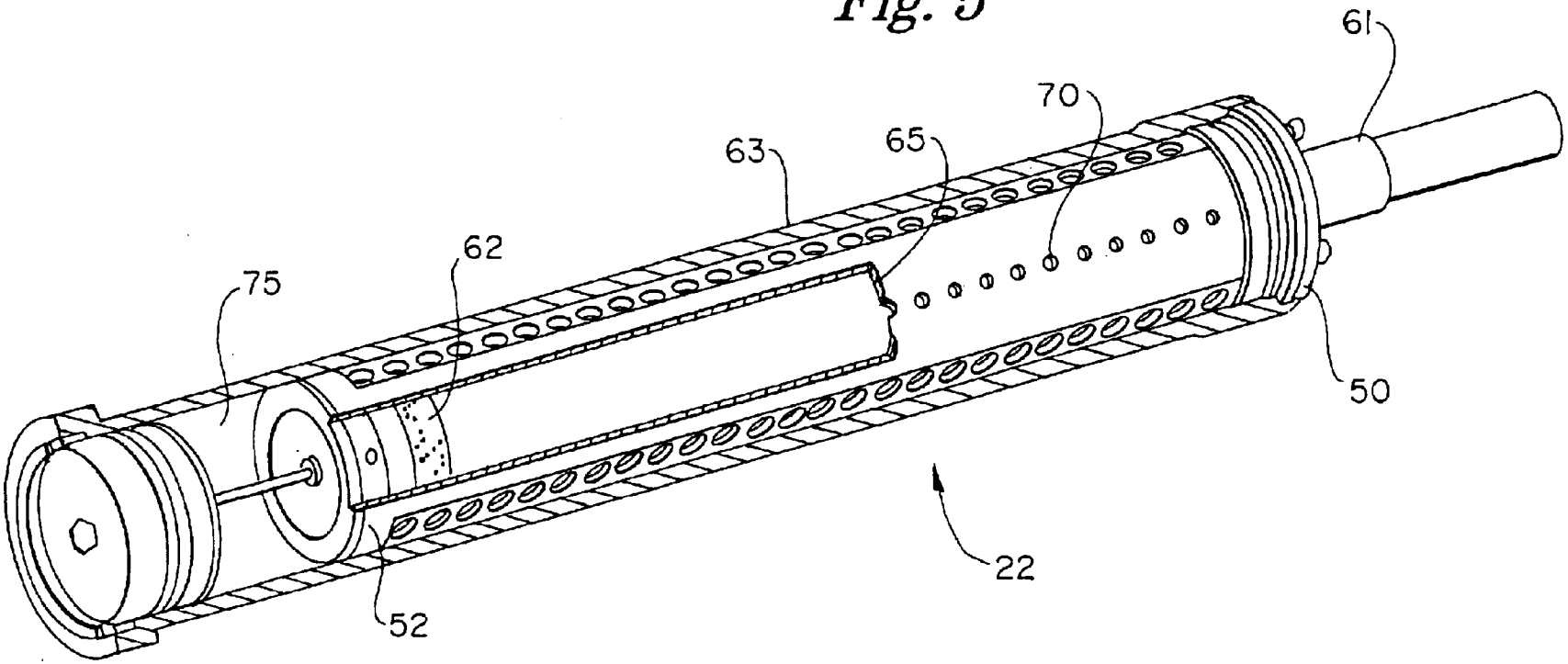
FIG. 5 is a perspective view of a recoil module with cut out section in which the return valve block and piston head are exposed.

As depicted in FIGS. 4 and 5, the supply line isolation system 54, disposed within inlet supply valve block 50, is comprised of an excess flow valve 56 and a normally closed check valve 58. A similar valve arrangement exists for the return line isolation system 59 disposed within the return valve block 52, comprising a mechanically operated two position, two port control valve 66, a normally closed pilot operated check valve 67 and a normally closed check valve 68. The placement of the supply line isolation system 54 and return line isolation system 59 within the manifold blocks 50 and 52 advantageously removes unnecessary hydraulic lines from the fluid circuit thus reducing potential leakage points, reducing system size, and consolidating the system for repair/diagnostics.

Figure 7:
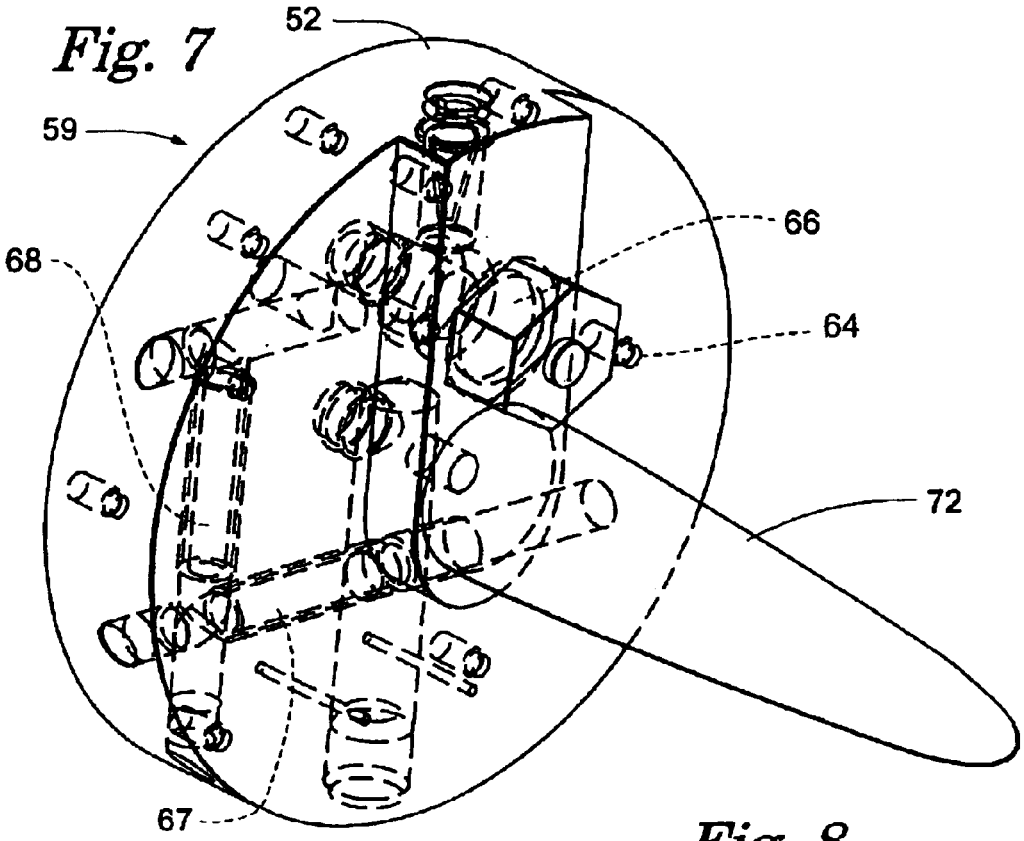
FIG. 7 is a perspective view of the return valve block with the fluid circuit represented in phantom.
Figure 8:
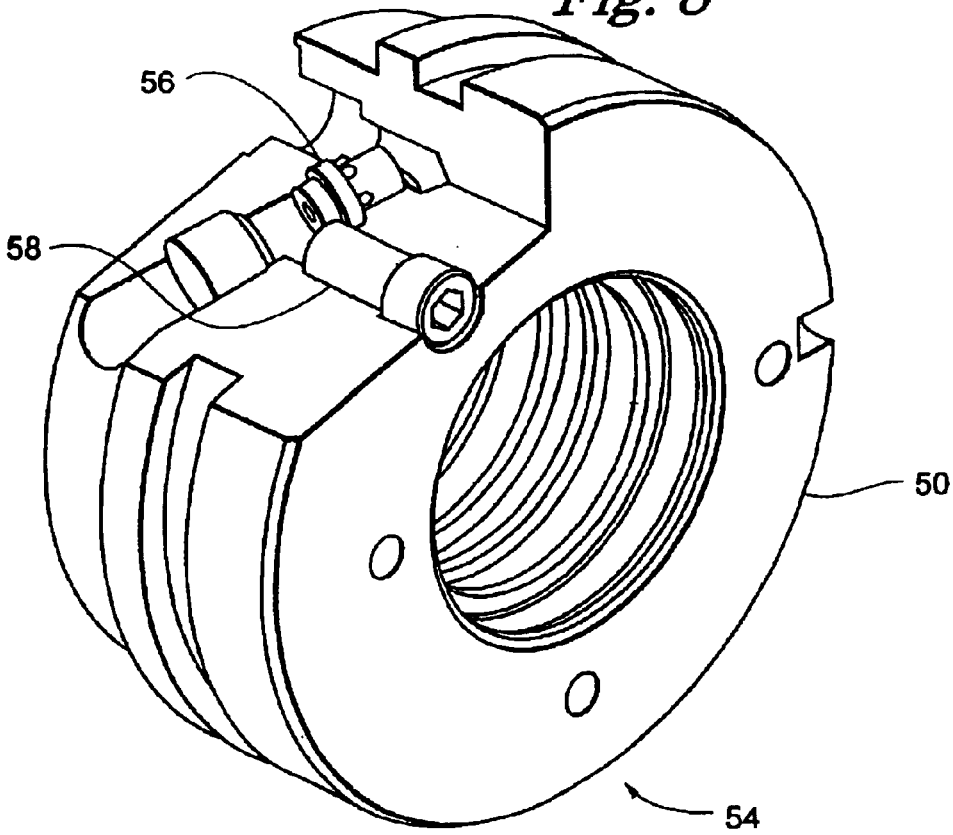
FIG. 8 is a perspective view of the inlet valve block with a cutout which depicts the fluid circuit with excess flow valve and check valve.

The valves 56, 58, 66, 67 and 68 themselves are readily available cartridge style valves which fit within cavities appropriately sized within the respective valve blocks 50 and 52. See FIGS. 7 and 8. Mounting and retention of valves 56, 58, 66, 67 and 68 may be accomplished through the use of an expanding sleeve, external threads or with an external holding device. For this embodiment, the valves 56, 58, 66, 67 and 68 operate in a temperature regime of −51F to +400F. The entire recoil module 22 can be fluidly disconnected by way of quick disconnect couplings 69 and 69' for servicing or replacement.

In FIG. 5, inlet supply valve block 50 is an annular metal flange through which piston rod 61 extends and freely travels. Piston rod 61 is anchored on one end to the gun barrel 14 in a manner well known to those in the art so that the piston rod 61 moves with gun 14 during recoil. A piston head 62, slidably arranged, disposed within and dimensioned closely to the inner diameter of the inner sleeve 65 of recoil chamber 63 is attached to the opposite end of piston rod 61. Inlet supply valve block 50 seals recoil chamber 63 on one end while return valve block 52 provides the seal at the opposing end.

In operation, firing of the howitzer results in a barrel 14 recoiling to the right (see FIG. 5) which forces the piston 61 to also travel to the right through recoil chamber 63. The recoil chamber 63 contains a perforated orifice sleeve 65 closely dimensioned to the diameter of the piston head 62. The inner sleeve 65 contains rows of perforations 70 which decrease in size from left to right. Therefore, the piston head 62 moves to the right with the recoil forcing hydraulic fluid within recoil chamber 63 through the perforations 70. The piston 61 slows as resistance and pressure increases ahead of the piston head 62 due to the reduction in size and number of the perforations 70. The hydraulic fluid forced through the perforations 70 travels between inner sleeve 65 and the inner face of recoil chamber 63 and is collected on the vacuum side of the piston head 62. While the recoil module 20 halts the rearward progress of the barrel 14, the recuperator 24, upon completion of the recoil cycle, progressively moves the barrel 14 back to the firing position.

The recoil brake isolation system 10 is activated under normal conditions by the operation of TDS pump 35. Upon sensing a return to a static state, the recoil brake isolation system 10 allows circulation when pump 35 produces sufficient pressure in the system to open check valve 58.

Referring to FIG. 4, supply hydraulic fluid first passes through the excess flow valve 56 on its way to the recoil module 22. In fluid communication with the excess flow valve 56 is check valve 58 which performs three functions. The check valve 58 is normally in a closed or blocked position. Check valve 58 is sized with a cracking pressure sufficiently high enough to close immediately if the supply pressure drops to atmospheric, as when the supply line is severed. The check valve 58 prevents fluid from leaving recoil chamber 63 and also prevents ingestion of air during counterrecoil. Check valve 58 opens due to the force exerted by pump 35 during normal cooling. When pump 35 turns off, line pressure decreases and check valve 58 reseats to a block position.

Excess flow valve 56 is also commonly referred to as a velocity valve, a line rupture valve, or a flow fuse. Excess flow valve 56 closes during counterrecoil to prevent an in-rush of fluid into the recoil module 22 since check valve 58 will be open. A vacuum condition downstream of valve 56 induces flow in excess of the valves operating requirements. This closure prevents excess fluid levels in the recoil chamber which would prevent the recoiling mass from regaining pre-fire positioning.

The return valve block 52, disposed proximate the end of recoil chamber 63, contains a check valve 68, a pilot operated check valve 67 and a mechanically operated two position, two port, cartridge style directional control valve 66. Return valve block 52, cylindrical in shape, forms a barrier between the recoil chamber 63 and the replenisher 75. A counterrecoil buffer 72 extends axially from the center of return valve block 52 into the recoil chamber 63. Piston head 62 contains a recessed central region sized so as to accommodate counterrecoil buffer 72 when the gun 14 is in battery.

Check valve 68, which acts as a relief valve, is normally in a closed position. It forms a bubble tight seal if return line 46 becomes severed, thus preventing loss of fluid or ingestion of air. The cracking pressure of check valve 68 is set above the maximum spring induced replenisher pressure. Check valve 68 is only open during normal cooling when the TDS pump 35 is operating. Check valve 68 reseats when pump 35 is turned off.

Disposed upstream from check valve 68 is pilot operated check valve 67. The main purpose of pilot operated check valve 67 is to close during the last few inches of the counterrecoil cycle when directional control valve 66 is activated but piston head 62 is still moving. The pilot port 64 is disposed approximately four inches from the piston head's 62 in battery position. During the end of counterrecoil the pressure at pilot port 64 will be at a vacuum thus closing valve 67.

When counterrecoil is complete, the piston head 62 will activate the mechanically operated two position, two-port directional control valve 66. While in battery, valve 66 allows circulation for cooling. The two way, two port directional control valve 66 is disposed immediately upstream from the pilot operated check valve 67. Its mechanical plunger extends into the recoil chamber 63. Due to the stroke distance of the plunger, which transitions valve 66 from open to closed, a time delay exists thus necessitating pilot operated check valve 67.

In the event that the supply line 44 is compromised due to TDS 30 failure or damage from an opposing force, the present invention must minimize the loss of hydraulic fluid and prevent the ingestion of air into the recoil module 22. Upon loss of the supply line 44, the inlet check valve 58 will immediately record the pressure drop which will allow the spring within the check valve 58 to block that line. Inlet check valve 58 will remain closed until repairs have been made. When the supply line 44 fails there is no longer any circulation during the static mode of the recoil cycle so outlet check valve 68 also remains closed.

In the event of a return line 46 failure, commencement of the isolation mode is dependent on whether or not the recoil coolant pump 35 is circulating fluid through the recoil module 22 at the moment of failure. As described above, the return line isolation system 59 blocks fluid flow to the TDS 30 during recoil and counter recoil. However, circulation does occur for cooling during the static mode when the pump 35 is activated. In a worst case scenario, if return line 46 is compromised while in a static mode with pump 35 running, hydraulic fluid will be lost until pump 35 runs dry and a pressure drop occurs in recoil chamber 63 resulting in check valve 66 closing. It may require up to 30 seconds for pump 35 to run dry. Check valve 68 will then remain closed until replacement or repairs are effectuated to the system. If return line 46 is compromised when the pump 35 is off, check valve 68 will already be blocking hydraulic fluid flow.

Although an embodiment of the invention has been illustrated in the accompanying drawings and described in the foregoing specification, it is especially understood that various changes such as in the relative dimensions of parts and materials used, modifications and adaptation, and the same are intended to be comprehended within the meaning and range of equivalent to the claims.

What is claimed is:

1. A recoil brake isolation system disposed within a recoil chamber, said recoil chamber fluidly connected to a hydraulic brake fluid circulation system which includes a hydraulic pump, a heat exchanger, a reservoir, a plurality of filters, an inlet supply line and an outlet supply line, the hydraulic brake fluid circulation system providing a thermally conditioned hydraulic fluid to the recoil chamber, the recoil brake isolation system comprising:

an inlet isolation valve system and an outlet isolation valve system so as to selectively isolate the recoil chamber from a the hydraulic brake fluid circulation system.

2. The recoil brake isolation system of claim 1 in which the inlet isolation valve system and outlet isolation valve system allow fluid circulation to the hydraulic brake fluid circulation system only during static conditions within the recoil chamber and while the hydraulic pump is operating.

3. The recoil brake isolation system of claim 1 wherein the inlet isolation valve system selectively blocks the flow of hydraulic fluid to and from the recoil chamber and prevents an ingestion of air.

4. The recoil brake isolation system of claim 3 wherein the inlet isolation valve system includes a plurality of valves mounted in series immediately upstream from the recoil chamber.

5. The recoil brake isolation system of claim 4 wherein the plurality of valves are fluidly triggered upon recognizing pressure differentials within the recoil chamber and upstream of the recoil chamber.

6. The recoil brake isolation system of claim 1 wherein the outlet isolation valve system selectively blocks the flow of hydraulic fluid to and from the recoil chamber and prevents an ingestion of air.

7. The recoil brake isolation system of claim 6 wherein the outlet isolation valve system includes a plurality of valves mounted in series immediately downstream from the recoil chamber.

8. The recoil brake isolation system of claim 7 wherein the plurality of valves are fluidly triggered upon recognizing pressure differentials within the recoil chamber and downstream of the recoil chamber.

9. A gun comprising a recoilable barrel mechanically connected to a recoil brake, said recoil brake including a recoil brake isolation system for the selective fluid connection of the recoil brake with a hydraulic brake fluid circulation system, the recoil brake isolation system including:

inlet flow control means for selectively allowing a hydraulic fluid to pass through an inlet valve block of the recoil brake; and outlet flow control means for selectively allowing the hydraulic fluid to pass through an outlet valve block of the recoil brake.

10. The gun of claim 9 wherein the inlet flow control means includes at least one valve triggered by flow and pressure conditions upstream from the recoil brake.

11. The gun of claim 9 wherein the inlet flow control means includes at least one valve triggered by flow and pressure conditions within the recoil brake.

12. The gun of claim 9 wherein the outlet flow control means includes at least one valve triggered by flow and pressure conditions downstream from a recoil chamber of the recoil brake.

13. The gun of claim 9 wherein the outlet flow control means includes at least one valve triggered by flow and pressure within the recoil brake.

14. The gun of claim 9 wherein the outlet flow control means and the inlet flow control means prevent ingestion of air into the recoil brake.

15. The gun of claim 9 wherein the inlet flow control means and the outlet flow control means allow fluid circulation to the recoil brake only during static conditions within the recoil brake and while the hydraulic brake fluid circulation system is operating.

16. A method of operating a recoil brake isolation system in fluid communication with a recoil brake cylinder and a fluidly connected hydraulic brake fluid circulation system, the method comprising:

monitoring flow conditions within the hydraulic brake fluid circulation system with a plurality of fluid control isolation valves disposed within the recoil brake cylinder;

monitoring flow conditions within the recoil brake cylinder;

blocking flow to and from the recoil brake cylinder when said monitoring indicates an improper flow condition; and opening flow to and from the recoil brake cylinder when said monitoring indicates a proper flow condition.

17. The method of claim 16 wherein a first set of said plurality of fluid control valves are inserted immediately upstream of the recoil brake cylinder and a second set of said plurality of fluid control valves are inserted immediately downstream of the recoil brake cylinder.

18. The method of claim 16 wherein said improper flow condition within the recoil brake cylinder occurs due to movement of a piston disposed within the recoil brake cylinder.

19. The method of claim 16 wherein said improper flow condition within the recoil brake cylinder and hydraulic brake fluid circulation system arises due to an interruption in fluid flow to the recoil brake cylinder.

20. The method of claim 16 wherein said improper flow condition within the recoil brake cylinder and hydraulic brake fluid circulation system arises due to an interruption in fluid flow from the recoil brake cylinder.

21. The method of claim 16 wherein said proper flow condition occurs within the recoil brake cylinder and hydraulic brake fluid circulation system when a piston disposed within the recoil brake cylinder is in a static position and the hydraulic brake fluid circulation system is operating.

22. A gun, including:

a barrel arranged to execute a recoil and a counterrecoil after a shot is fired;

a recoil brake cylinder containing an operative fluid;

a piston received in said recoil brake cylinder and secured at least indirectly to said barrel to move as a unit with during recoil and counterrecoil, said piston comprising a piston head and a piston rod, said piston head axially slidably received in said recoil brake cylinder and being secured to said piston rod for axial movement;

a hydraulic power unit for transmission of fluid under pressure to said recoil brake cylinder;

a hydraulic brake fluid circulation system conveying said fluid to and from said recoil brake cylinder; and an inlet isolation valve system and an outlet isolation valve system disposed so as to selectively isolate the recoil brake cylinder from said hydraulic brake fluid circulation system.

23. The gun of claim 22 wherein the hydraulic brake fluid circulation system supplies a thermally conditioned hydraulic fluid to the recoil brake cylinder.

24. The gun of claim 23 wherein the hydraulic brake fluid circulation system includes a hydraulic pump, a heat exchanger, a reservoir, a plurality of filters, an inlet supply line and an outlet supply line.

25. The gun of claim 24 in which the inlet isolation valve system and outlet isolation valve system allow fluid circulation to the hydraulic brake fluid circulation system only during static conditions within the recoil brake cylinder and while the hydraulic pump is operating.

26. The gun of claim 22 wherein the inlet isolation valve system selectively blocks the flow of hydraulic fluid to and from the recoil brake cylinder and prevents an ingestion of air.

27. The gun of claim 26 wherein the inlet isolation valve system includes a plurality of valves mounted in series immediately upstream from the recoil brake cylinder.

28. The gun of claim 27 further comprising an inlet supply line and wherein the plurality of valves are fluidly triggered by pressure differentials within the recoil brake cylinder and the inlet supply line.

29. The gun of claim 22 wherein the outlet isolation valve system selectively blocks the flow of hydraulic fluid to and from the recoil brake cylinder and prevents an ingestion of air.

30. The gun of claim 29 wherein the outlet isolation valve system includes a plurality of valves mounted in series immediately downstream from the recoil brake cylinder.

31. gun of claim 30 further comprising an outlet supply line and wherein the plurality of valves are fluidly triggered by pressure differentials within the recoil brake cylinder and the outlet supply line.

* * * * *

UNITED STATES PATENT AND TRADEMARK OFFICE

CERTIFICATE OF CORRECTION

PATENT NO. : 6,802,406 B2
DATED : October 12, 2004
INVENTOR(S) : Joel Martin

It is certified that error appears in the above-identified patent and that said Letters Patent is hereby corrected as shown below:

Column 1,
Line 15, please delete “any, of” and insert -- any of --

Column 3,
Line 34, please delete “MWL” and insert -- MIL --
Line 35, please delete “PRF46176” and insert -- PRF 46176 --

Column 6,
Line 50, please delete “a”

Signed and Sealed this

Twenty-fourth Day of May, 2005

JON W. DUDAS
*Director of the United States Patent and Trademark Office*